United States Patent [19]

Jonas

[11] 4,144,692

[45] Mar. 20, 1979

[54] BUILDING UNIT

[76] Inventor: Gerald L. Jonas, 2217 Pacific Ave., San Francisco, Calif. 94115

[21] Appl. No.: 793,281

[22] Filed: May 3, 1977

[51] Int. Cl.[2] ..... E04B 1/18; E04C 3/00

[52] U.S. Cl. ..... 52/637; 52/79.1; 52/169.9; 52/236.3

[58] Field of Search ..... 52/79.1, 79.13, 169.9, 52/236.3, 637; 40/25–29

[56] References Cited

U.S. PATENT DOCUMENTS

| | | | |
|---|---|---|---|
| 2,311,988 | 2/1943 | Lavin | 52/637 |
| 3,243,927 | 4/1966 | Hilson | 52/169.9 |
| 3,744,200 | 7/1973 | Rice | 52/79.13 X |
| 3,783,565 | 1/1974 | Hughes | 52/648 X |

FOREIGN PATENT DOCUMENTS

| | | | |
|---|---|---|---|
| 40879 | 3/1956 | Poland | 52/79.1 |
| 756737 | 9/1956 | United Kingdom | 52/648 |
| 208243 | 7/1968 | U.S.S.R. | 52/637 |

*Primary Examiner*—Alfred C. Perham
*Attorney, Agent, or Firm*—Phillips, Moore, Weissenberger, Lempio & Majestic

[57] ABSTRACT

A building unit is made up of a generally straight elongated portion and a pair of generally straight, substantially parallel, spaced-apart legs extending in the same direction therefrom. Units may be used in various combinations, in particular to form a building frame structure having two generally U-shaped portions with limbs thereof connected by connecting members, in the shape of "Demi-Cubic" frame.

15 Claims, 10 Drawing Figures

FIG. 2.
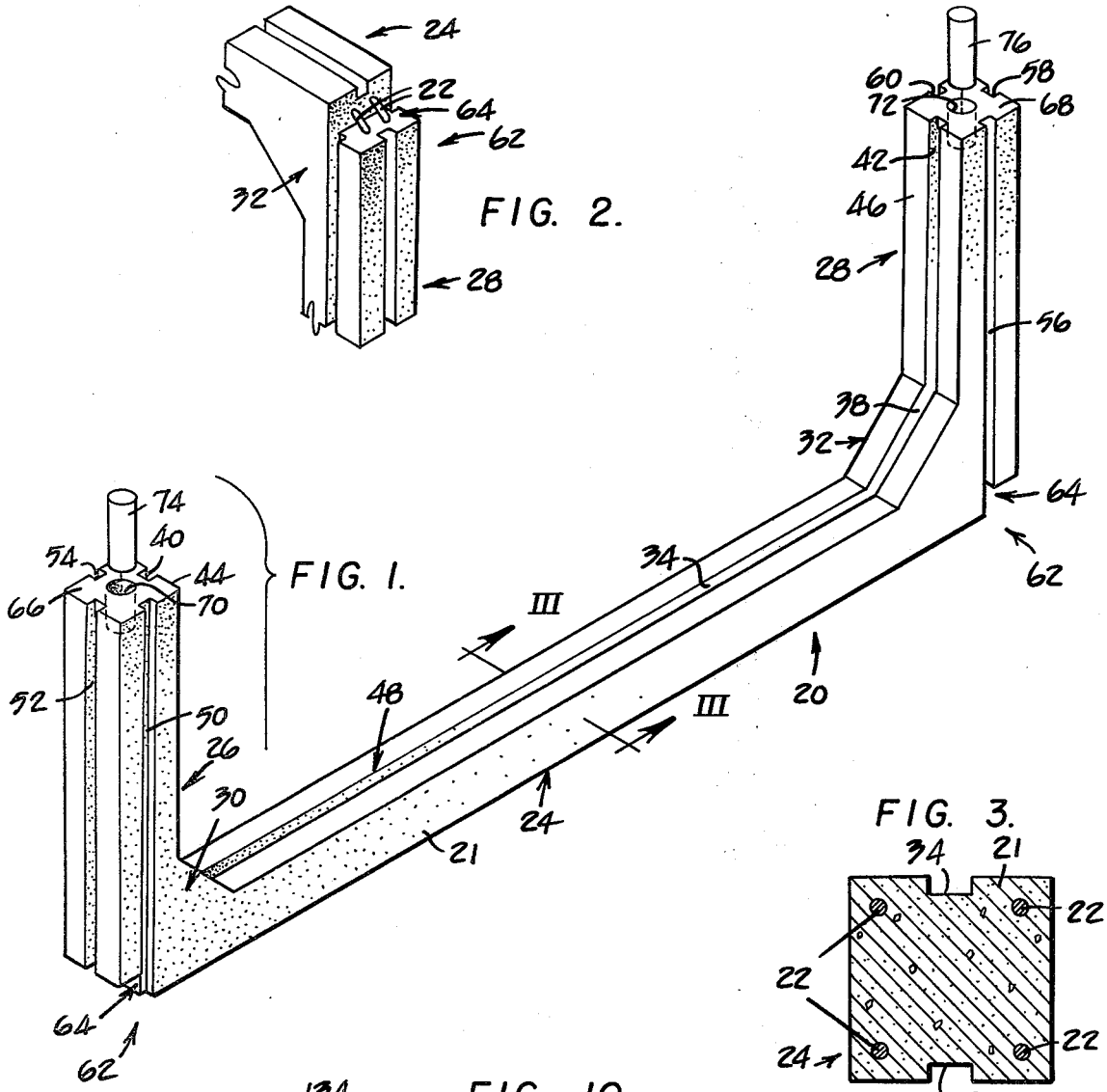
FIG. 1.
FIG. 3.
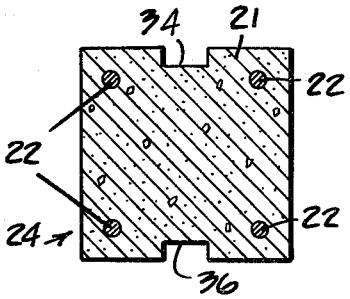
FIG. 10.
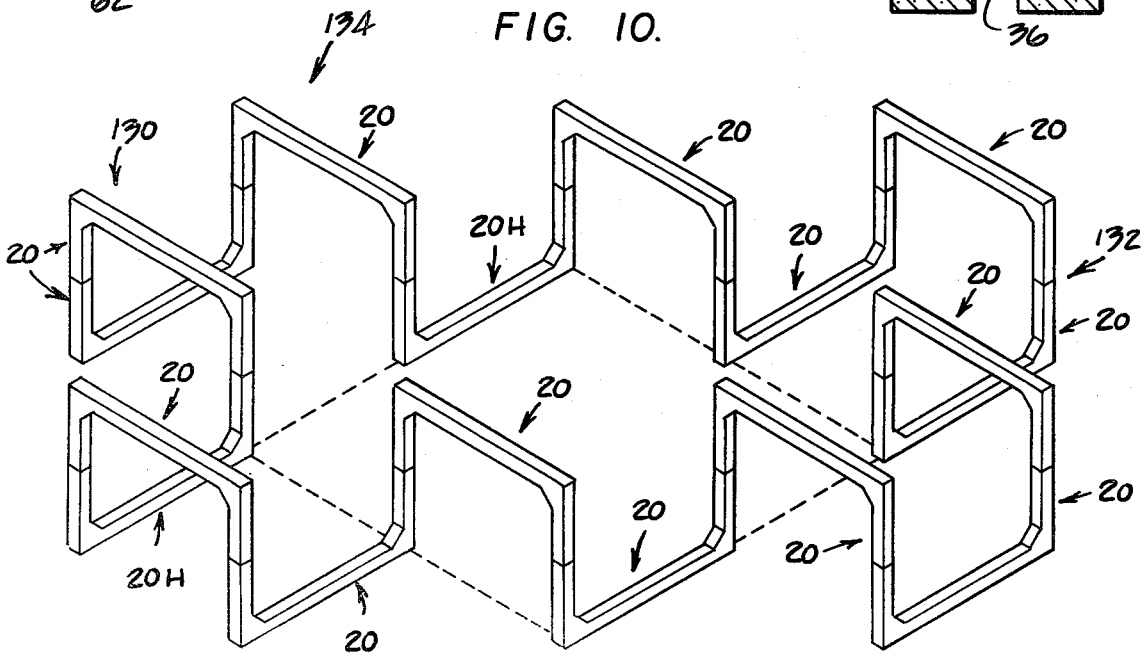

124
78"
110
118
116
126
118
116
78
118
20
78'''
120
122
112
78'

78
20
24
122
26
123
64
62

112
114
48
20

BUILDING UNIT

BACKGROUND OF THE INVENTION

As is well known, a full cubic frame includes twelve edge members secured together in such a fashion as to form an overall cube. The construction of such a frame requires careful placement of the twelve edge members so that the overall final cube structure is properly formed.

It should be understood that it is highly desirable to simplify the formation of building frames of this general type, and in particular to provide such frames of this general type which minimize the overall use of material without sacrificing frame strength. Additionally, it will be understood that it is also highly desirable that a frame of this general type be constructed of, for example, a number of substantially identical parts which can be easily handled and assembled to provide an appropriate frame. By utilizing a number of identical units, such units can be economically performed in a standard manner, and then be used so as to form such frame through relatively simple operations by on-site, relatively unskilled labor. Additionally, such units should with advantage lend themselves to use in various combinations to provide a variety of frame structures, depending on the requirements involved. For example, such units should, with advantage, be capable of assembly to provide single or multiple dwellings of one storey or more.

SUMMARY OF THE INVENTION

It is accordingly an object of this invention to provide a building unit which can be used in various combinations thereof to provide a building frame structure which is extremely efficient in use and utilizes a minimum of material.

It is a further object of this invention to provide a building unit which can be conveniently manufactured and easily handled in the construction of such a frame so as to reduce labor costs.

Broadly stated, the invention comprises a building unit comprising a generally straight elongated portion and a pair of generally straight, substantially parallel, spaced-apart legs extending therefrom, the legs defining respective extended ends, and means operatively associated with each end for providing that that end may be coupled to an end of another building unit.

BRIEF DESCRIPTION OF THE DRAWINGS

These and other objects of the invention will become apparent from a study of the following specification and drawings, in which:

FIG. 1 is a perspective view of a building unit incorporating the invention;

FIG. 2 is a perspective view of a portion of the apparatus of FIG. 1;

FIG. 3 is a sectional view taken along the line III—III of FIG. 1;

FIG. 10 is a perspective view of a variation of building structure incorporating the building units of FIGS. 1–3.

DESCRIPTION OF THE PREFERRED EMBODIMENT

Figure 4:
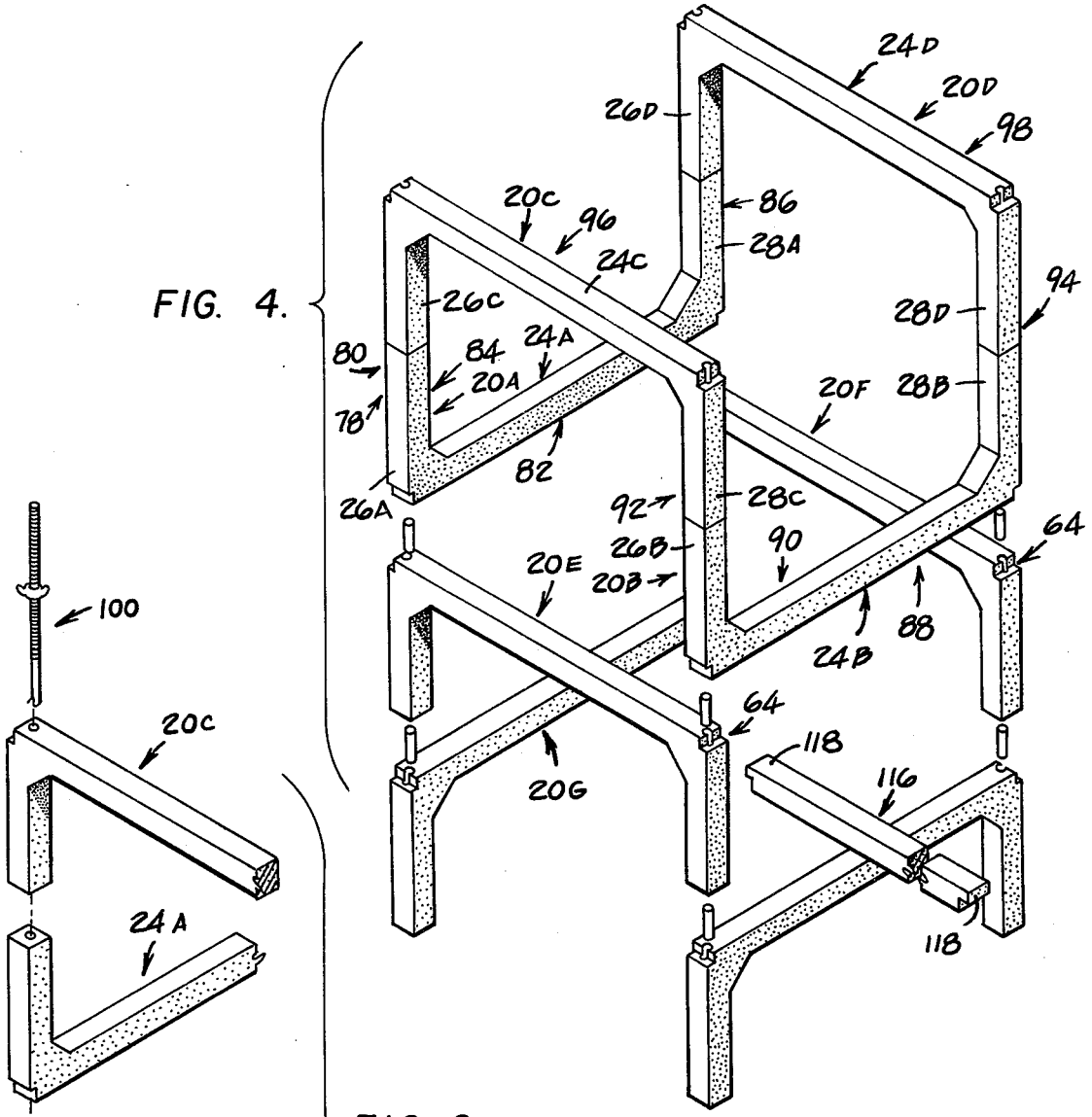
FIG. 4 is an exploded perspective view of a building structure incorporating building units in accordance with FIGS. 1–3.
Figure 6:
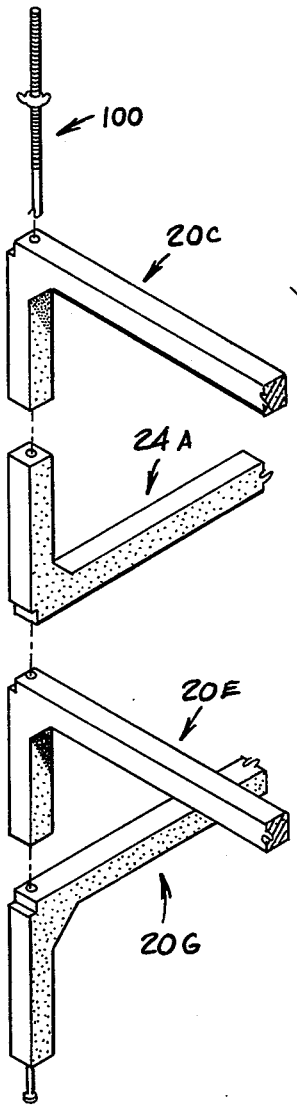
FIG. 6 is a perspective view of portions of building units, showing a variation in the connections thereof.

Shown in FIGS. 1–3 is the basic building unit 20. Such unit 20 is of reinforced concrete 21, incorporating reinforcements 22 therein as shown in FIGS. 2 and 3. The unit 20 includes a generally straight elongated portion 24 of square cross-section (FIG. 3), and a pair of generally straight, substantially parallel, spaced-apart legs 26, 28 extending therefrom. The legs 26, 28 extend in the same direction from the elongated portion 24, with each leg being positioned at an end of the elongated portion 24. Each leg is also square in cross-section, being of the same cross-sectional dimensions as the elongated portion 24. A haunch 30 connects the elongated portion 24 and the leg 26, and a haunch 32 connects the elongated portion 24 and the leg 28, for strengthening purposes to be further described.

The elongted portion 24 has elongated grooves 34, 36 therein on opposite sides thereof, running substantially parallel to the longitudinal axis of the elongated portion 24. The groove 34 connects up with grooves defined by the haunches 30, 32 (one shown at 38), which in turn connect up with elongated grooves 40, 42 in the sides 44, 46 of the legs 26, 28 which face each other. These elongated grooves 40, 42 run substantially parallel to the longitudinal axes of the respective legs 26, 28. The grooves 34, 38, 40, 42 make up continuous groove means 48 with the grooves 34, 38, 40, 42 lying in the same plane. In fact, each other side of the leg 26 has an elongated groove 50, 52, 54 running substantially parallel to the longitudinal axis of that leg 26, and each other side of the other leg 28 has an elongated groove 56, 58, 60 running substantially parallel to the longitudinal axis of that leg 28. The groove 36 of the elongated portion 24 and the grooves 52, 58 of the legs 26, 28 also lie in the plane in which the grooves 34, 38, 40, 42 lie.

In this embodiment, the legs 26, 28 are of substantially the same length.

With each leg being positioned generally at an end of the elongated portion 24, each leg defines with the elongated portion a unit corner 62 (FIG. 2). The elongated portion 24 defines with each leg 26, 28 a square-cut recess 64 at the outer periphery of each corner 62.

The legs 26, 28 define respective extended ends 66, 68, each of which may be coupled to an end of another building unit 20 in accordance with the following description. The particular embodiment of unit 20 shown in FIGS. 1–3 includes bores 70, 72 defined in the respective extended ends 66, 68 of the legs 26, 28. Dowels 74, 76 are seatable in the respective bores 70, 72, and are sized so that they extend beyond the respective extended ends 66, 68 of the legs 26, 28 when seated therein. It will be seen that, in general accordance with FIG. 4, a dowel 74 may be fitted into, for example, the bore 70 in the leg 26 of unit 20, and another unit 20 may be positioned such that the bore therein is fitted onto the portion of dowel 74 beyond the extended end 66 of the leg 26.

The upper portion 78 of the FIG. 4 structure, including four units 20A, 20B, 20C, 20D is of the form which, when fully assembled as shown, may be called "Demi-Cubic". As shown therein, the four identical units 20A, 20B, 20C, 20D are positioned such that the units 20A, 20B are in generally side-by-side spaced relation, the unit 20C interconnects the unit 20A, 20B, and the unit 20D interconnects the units 20A, 20B, coupling of such four units 20A, 20B, 20C, 20D being in accordance with the above description. The building structure, upon such assembly, takes the general form having a first generally U-shaped portion 80 having a base portion 82 and first and second limbs 84, 86 extending therefrom, and a second generally U-shaped portion 88 having a base portion 90 and first and second limbs 92, 94, extending therefrom. The U-shaped portions 80, 88 are in spaced-apart relation, and the limbs 84, 92 are connected by a connecting portion 96, and the limbs 86, 94 are connected by a connecting portion 98.

The above is a general description of the overall assembled building structure 78 incorporating four of the units 20. However, it will readily be seen that the base portion 82 is made up of the elongated portion 24A of the unit 20A, with the limb 84 being made up of leg 28A and leg 26C, and the limb 86 being made up of leg 26C and leg 28A. Likewise, the base portion 90 of the U-shaped portion 88 is made up of the elongated portion 24B of the unit 20B, with the limb 92 being made up of legs 28C and 26B, and the limb 94 being made up of leg 28D and leg 28B. Meanwhile, the connecting portion 96 is actually made up of the elongated portion 24C of unit 20C, and connecting portion 98 is made up of the elongated portion of unit 20D. In the assembled structure 78, of course, the extended end of the leg 26C is in contact with the extended end of the leg 26A, the extended end of the leg 28C is in contact with the leg 26B, the extended end of the leg 28B is in contact with the extended end of the leg 28D, and the extended end of the leg 26D is in contact with the extended end of the leg 28A.

It is to be seen that, when compared with the twelve-edged cube structure described above, one-third of the material has been eliminated. Also, it will be seen that four identical parts 20 are used to construct such a building structure, such units being capable of easy and convenient handling for easy assembly thereof. Yet, because of the particular design and construction of each unit, a high degree of structure rigidity and strength is obtained.

It should also be noted that the units 20 are joined together at the least critical point which is described in engineering terms as a region of low moment and high shear. Additionally, all horizontal loads, for example, wind and seismic, are taken by the haunches and shear connections. It should also be understood that grout may be used in the coupling of the legs of the units, in addition to the dowels.

Referring further to FIG. 4, the units 20A, 20B are shown for placement on the elongated portions of respective other units 20E, 20F. Again, dowel and bore connections, with grout as necessary, are used for such joints. In this way, building structures may be stacked on each other in a highly efficient structural manner.

Figure 5:
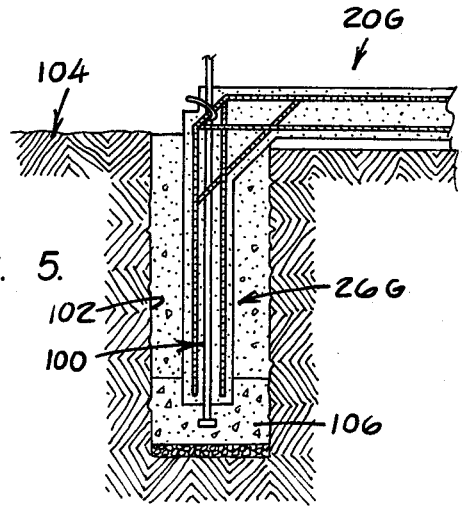
FIG. 5 is a side elevation of a building unit used as a footing for a building structure.

As an alternative, a tensioned tie rod 100 may be used in place of the dowel system described above, the tie rod extending from the top unit 20C through the leg 26C thereof, through other respective legs of the units 20A, 20E, with the bottom end thereof secured to a footing of the building structure. In this light, FIG. 5 shows a unit 20G being used as footing for a structure. As shown therein, the legs (as at 26G) of a unit 20G are positioned in holes 102 in the ground 104, and are set in concrete 106, with the legs 26G, 28G and concrete 106 acting as piers, and the elongated portion 24G acting as a grade beam.

Figures 7, 8, 9:
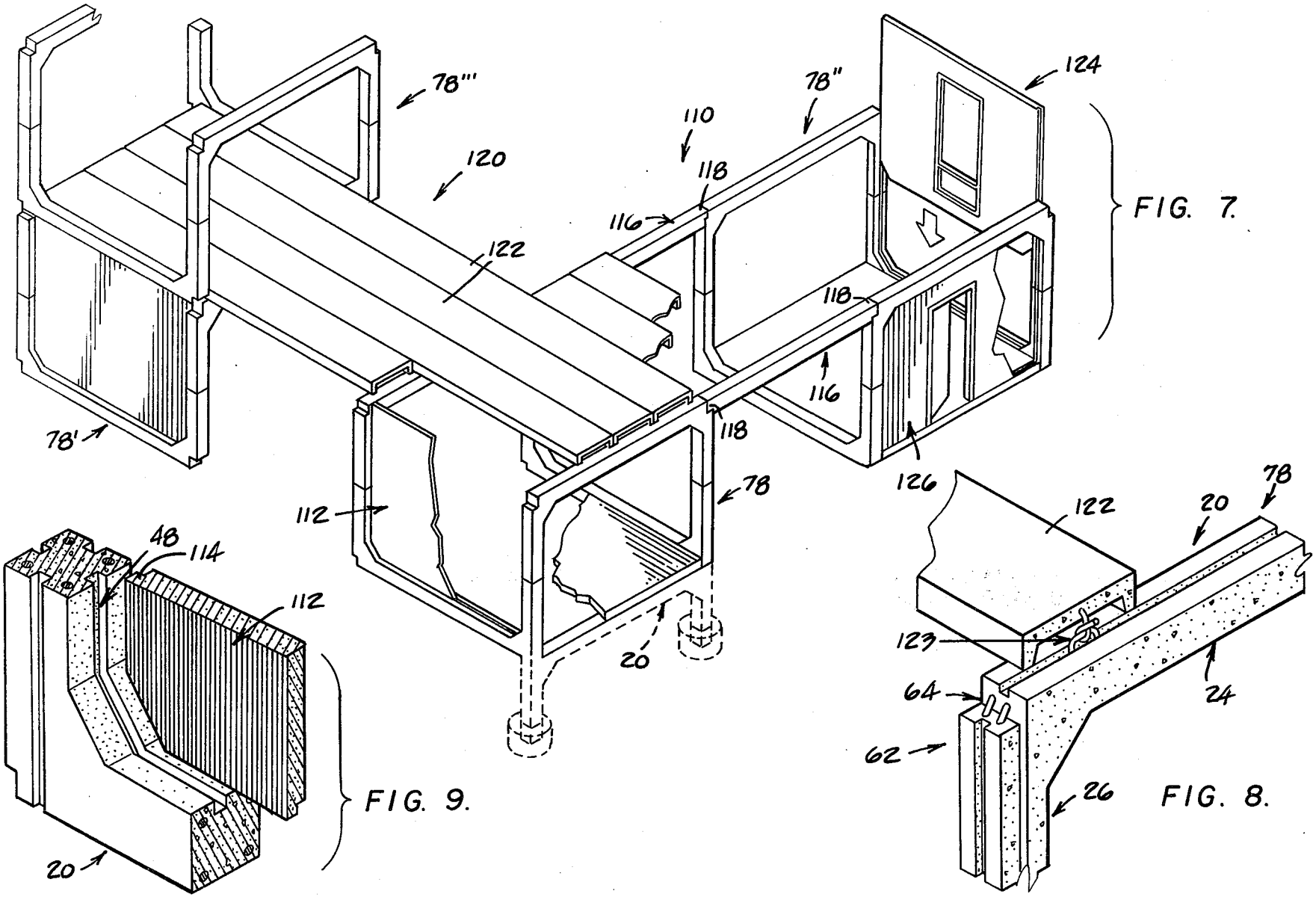
FIG. 7 is a perspective view of a portion of a building incorporating building structures utilizing the building units of the present invention.
FIG. 8 is an enlarged view of a portion of the apparatus of FIG. 7.
FIG. 9 is an enlarged view of another portion of the apparatus of FIG. 7.

FIGS. 7–9 show a portion of a sample building 110 incorporating the inventive structure. Initially, a unit 20 and others like them are used as footings, and a "Demi-Cubic" structure 78 is build thereon in accordance with the above. Because of the groove structure defined above, for example, a panel 112 may be placed in accordance with FIGS. 7 and 9, such panel 112 having an edge 114 to properly seat in, for example, the groove means 48 of the unit 20. Another "Demic-Cubic" structure 78′, is placed as shown. The structures 78, 78′, 78″ are positioned and spaced as shown in FIG. 7, having spaces therebetween but being identically correspondingly positioned. Beams 116 interconnect the structures 78 in one direction, each beam 116 including steps 118 which seats in a respective recesses 64 of corners of adjacent units. Such beams 116 may be secured to the structures by the dowel and grout arrangement described above. Because of the spacing of the structures 78 78′, 78″, as set forth, access may be had thereto by a truck, so that a large crane or the like is not required for construction.

Joining units 78 in the other direction is flooring 120 made up of elongated flooring members 122, the end of which may be secured to the units 20 by means 123, shown in FIG. 8. A "Demi-Cubic" structure 78‴ is fitted on the structure 78′ in accordance with the previous description, and a second storey may thus be built. The thickness of the flooring 120 is chosen so that the top level of the flooring 120 is flush with the top levels of the elongated portions 24. Thus, a smooth overall flooring means for the second storey is provided.

It will be seen in accordance with FIG. 7 that other panesl 124, 126, for example, including doors and windows, may be appropriately fitted because of the particular structure of the grooves set forth above.

It should be noted that the panels or walls themselves are not supporting elements. This means that a structure 78 incorporating the units 20 may be opened up as required, and wall surfaces may be articulated in an infinite variety of ways. The units 20 themselves are easily handled, and may be assembled by relatively unskilled labor in a simple manner. As all units 20 are identical, if one is damaged, another can be substituted therefor.

Because of the method of coupling units 20, there is no possibility of error of placement or of dimensional inter-relationship. Since panels may be slipped into place as the units 20 are erected into a structure, overall construction time is greatly reduced.

It should also be noted that the unit 20 lends itself to usage in varied geographical areas. For example, the selection of enclosure roof and floors may be made from materials which are readily available locally. In certain parts of the world, it may be advantageous to use adobe or mud brick walls, while in others, reed, bamboo or light screen materials may be used.

It is also to be noted that since identical units 20 serve for columns, beams and footings, the use and handling of such items or units 20 is quickly learned. Also, production of joints, always a major expense in building, has been taken care of, since the unit 20 inherently includes all the difficult joints which may be involved in the building of a structure.

It should also be understood that the units 20 are capable of use in a wide variety of configurations, not necessarily wherein a true "Demi-Cubic" structure is provided. For example, as shown in FIG. 10, units 20 are used to form one generally U-shaped structure 130, but instead of a generally U-shaped structure being formed thereadjacent, outwardly extending units 20H are provided. From these units 20H, other units 20 alternate back and forth at 90° to the other end 132 of the overall structure wherein the opposite end 134 of the overall structure is generally repeated. Structures which require etched roofs may be constructed by providing units of longer legs.

A basic structure incorporating the units 20 is strong and fire-proof, and two and three or more storey housing may be built. The units 20 lend themselves to building on a hillside, through provision of legs of different length on a unit, or by varying the length of the legs from unit to unit.

It will therefore be seen that the unit 20 provided herein greatly simplifies the formation of the building of frames. In particular, the use of four such units 20 in accordance with the above description provides a "Demi-Cubic" frame which minimizes the overall use of material without sacrificing frame strength. Since the units 20 are generally identical in configuration, they may be easily handled and assembled to provide an appropriate frame. The units 20 can be economically formed in a standard manner, and can be used to provide a wide variety of frame configurations.

Construction of a building is greatly facilitated by having such "Demi-Cubic" frames (as at 78) being inherently rigid and completely without the necessity of temporary bracing or additional structural members.

The tie rod system has special advantages if the structure is built in an area of high winds or the like.

It will also be seen that a variety of material can be used in forming the units 20.

What is claimed is:

1. A building unit comprising a generally straight elongated portion and only one pair of generally straight, substantially parallel, spaced-apart legs extending therefrom, the legs defining respective extended ends, and means operatively associated with each end for providing that that end may be coupled to an end of another building unit, wherein the legs extend in substantially the same direction from the elongated portion; wherein each leg is positioned generally at an end of the elongated portion; wherein each of the legs is substantially rectangular in cross-section; wherein each side of each leg has an elongated groove running substantially parallel to the longitudinal axis of that leg; wherein one side of one leg faces one side of other leg; wherein the elongated grooves of the facing sides lie on the same plane, and wherein the elongated portion has an elongated continuous groove therein lying in said plane; and further comprising brace means operatively coupling the elongated portion and each leg, wherein the brace means comprise a first haunch connecting the elongated portion and one leg, and a second haunch connecting the elongated portion and the other leg.

2. The unit of claim 1 wherein the elongated portion is substantially rectangular in cross-section.

3. The unit of claim 1 wherein each of the legs is substantially square in cross-section, and wherein the elongated portion is substantially square in cross-section.

4. The unit of claim 1 wherein the means operatively associated with each end for providing that that end may be coupled to an end of another building unit comprise a bore defined in that end of the leg.

5. The unit of claim 4 and further comprising dowel means seatable in the bore defined by that end of the leg and extending beyond the extended end of that leg when seated therein.

6. The unit of claim 1 wherein each leg defines with the elongated portion a unit corner, and wherein the elongated portion defines with each leg a recess at the outer periphery of each corner.

7. The unit of claim 1 wherein each leg is substantially the same length.

8. The apparatus of claim 1 wherein the unit comprises footing structure.

9. The apparatus of claim 1 including a first said building unit, a second said building unit, a third said building unit, a fourth said building unit, and a fifth said building unit, wherein an extended end of a first leg of said first building unit contacts an extended end of a first leg of the second building unit, and an extended end of a second leg of the first building unit contacts an extended end of a first leg of the third building unit, and wherein an extended end of a second leg of the second building unit contacts an extended end of a first leg of the fourth building unit, and wherein an extended end of a second leg of the third building unit contacts an extended end of a first leg of the fifth building unit.

10. The apparatus of claim 1 including a first said building unit, a second said building unit, and a third said building unit, wherein an extended end of a first leg of the first building unit contacts an extended end of a first leg of the second building unit, and wherein an extended end of the second leg of the first building unit contacts an extended end of the first leg of the third building unit, and wherein the second and third building units are selectively positionable so as to be (1) orientated perpendicularly with respect to each other, and (2) orientated so as to lie in the same plane, and (3) orientated so as to be parallel to each other and extending in opposite directions from the first building unit.

11. A building structure being of the general shape having a first generally U-shaped portion having a base portion and only first and second limbs extending therefrom, and a second generally U-shaped portion having a base portion and only first and second limbs extending therefrom, the first and second generally U-shaped portions being in spaced-apart relation, a first connecting portion interconnecting the first limb of the first generally U-shaped portion, and the first limb of the second generally U-shaped portion, and a second connecting portion interconnecting the second limb of the first generally U-shaped portion, and the second limb of the second generally U-shaped portion, the building structure comprising first, second, third and fourth substantially identical building units, each building unit having an elongated portion, and only first and second legs extending therefrom in parallel, spaced-apart relation, and extending in the same direction from the elongated portion, the elongated portion of the first unit making up the base of the first generally U-shaped portion of the structure, the elongated portion of the second unit making up the base of the second generally U-shaped portion, one leg of the third unit being in contact with one leg of the first unit, the other leg of the third unit being in contact with one leg of the second unit, one leg of the fourth unit being in contact wtih the other leg of the first unit, and the other leg of the fourth unit being in contact with the other leg of the second unit; wherein each said leg is substantially rectangular in cross-section; wherein each side of each leg has an elongated groove running substantially parallel to the longitudinal axis of that leg; wherein one side of one leg of each unit faces one side of the other leg of that unit; wherein the elongated grooves in said facing sides lie in the same plane, and wherein the elongated portion of each unit defines an elongated continuous groove, which groove lies in said plane, and wherein each leg is positioned at an end of the associated elongated portion; and further comprising brace means operatively associated with each unit, which brace means operatively couple the elongated portion of that unit and each leg thereof, and wherein the brace means associated with each unit comprise a first haunch connecting the elongated portion of that unit and one leg thereof, and a second haunch interconnecting the elongated portion of that unit and the other leg thereof.

12. The building structure of claim 11 wherein each leg is substantially the same length.

13. The apparatus of claim 11 wherein each of the elongated portions is substantially rectangular in cross-section.

14. The apparatus of claim 11 wherein each of the legs is substantially square in cross-section, and wherein the elongated portion is substantially square in cross-section.

15. The apparatus of claim 11 wherein each unit has continuous groove means therein, defined by one leg, the first haunch, the first elongated portion, the second haunch, and the other leg thereof.

* * * * *